United States Patent [19]

Bates et al.

[11] Patent Number: 4,506,619

[45] Date of Patent: Mar. 26, 1985

[54] WING SAIL DRIVE SYSTEM

[75] Inventors: Alexander P. Bates, Hingham; Philip E. Harcourt, Norwell, both of Mass.

[73] Assignee: Lloyd Bergeson, Norwell, Mass.

[21] Appl. No.: 416,080

[22] Filed: Sep. 8, 1982

[51] Int. Cl.[3] ..... B63H 9/06

[52] U.S. Cl. ..... 114/91; 114/90; 114/39; 114/103; 114/93

[58] Field of Search ..... 114/39, 90, 91, 272, 114/273, 103, 93; 188/29, 82.2, 196 D; 74/126, 111, 152, 154, 155; 244/11, 22, 72; 440/13, 14, 37

[56] References Cited

U.S. PATENT DOCUMENTS 3,442,113 5/1969 Beckwell ..... 74/111

3,580,203 5/1971 Martin ..... 114/102

3,874,619 4/1975 Collins et al. ..... 74/126

*Primary Examiner*—Trygve M. Blix

*Assistant Examiner*—Edwin L. Swinehart

*Attorney, Agent, or Firm*—Robert E. Ross

[57] ABSTRACT

A hydraulic drive system for a wing sail on a vessel, comprising a rotatable frame at the base of the mast and hydraulic cylinders connected between the frame and the ship's structure to cause rotation of the frame in either direction through a limited angle, and a brake is provided on the frame for transmitting rotation of the frame to the mast when the frame is rotating in a direction that it is desired for the mast to rotate, and a brake is provided for preventing rotation of the mast when the frame rotates in the opposite direction, whereby the mast may be rotated through a desired angle by oscillatory movement of the rotatable frame.

6 Claims, 8 Drawing Figures

WING SAIL DRIVE SYSTEM

SUMMARY OF THE INVENTION

This invention provides a hydraulic drive system for a wing sail of the type described in the above identified patent application, in which a sail in the form of an airfoil is mounted on a rotatable mast. In this invention, a rotatable frame is provided around the base of the mast, and one or more hydraulic cylinders are connected between the rotatable frame and the ships structure to cause rotation of the frame in either direction through a limited angle. Hydraulically actuated holding brake means is provided on the ships structure to provide a braking effect on the mast, and drive brake means is mounted on the rotatable frame to provide braking action between the rotatable frame and the mast.

Hydraulic control means is provided for sequentially actuating the hydraulic cylinders so that the holding brakes are released, the driving brakes engaged, and the driving cylinders actuated to rotate the frame and the mast in a desired direction through a limited angle. At the end of the stroke of the driving cylinders, the holding brake is engaged, the drive brake released, and the driving cylinders retracted to return the driving frame back to its original position. If further rotation of the mast is needed, the cycle can be repeated. The system allows the mast to be rotated stepwise through any desired angle in either direction without the need for having driving cylinders with excessively long strokes, and allowing 360 degree rotation of the wing sail.

DESCRIPTION OF THE ILLUSTRATED EMBODIMENT

Figure 2:
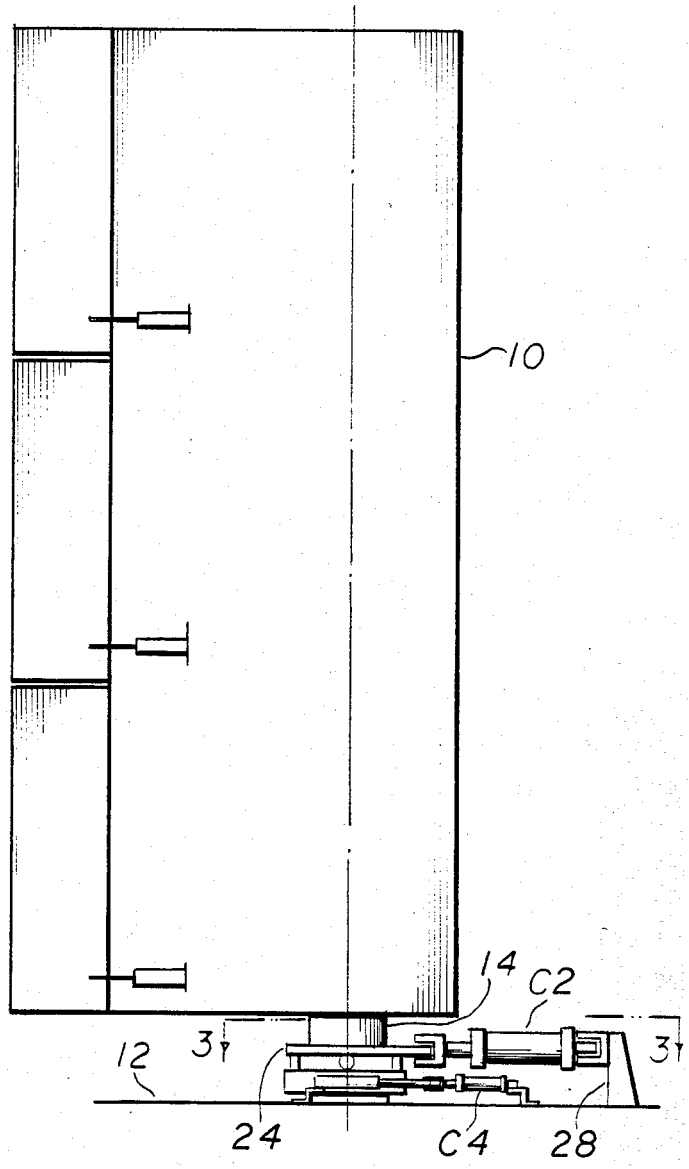
FIG. 2 is an enlarged view of a portion of FIG. 1.
Figure 1:
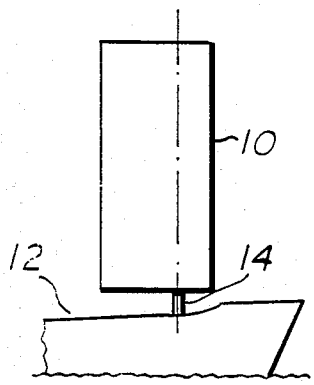
FIG. 1 is a view in side elevation showing a wing sail embodying the features of the invention mounted on the deck of a ship.

Referring to the drawing, there is illustrated a wing sail 10 mounted onto the deck 12 of a ship. The wing sail 10 is supported by a hollow rotatable mast 14 which is mounted over a support post 16 fixed to the ship's deck. Suitable bearing members 18 are provided between the mast and the support 16 to support the mast and to allow free rotation of the mast on the support.

Fixed to the lower end of the mast so as to rotate therewith is a cylindrical member 20 which has an outer braking surface 22 for a purpose to appear hereinafter. Rotatably mounted on the upper edge of the cylindrical member 20 is a driving frame 24 having rollers 26 disposed on said edge.

The frame 24 is driven in rotation through a predetermined limited angle in either direction by a pair of hydraulic cylinders C1 and C2 mounted between the frame and suitable support posts 28 and 30 mounted on the deck 12. The hydraulic control to the cylinders C1 and C2 is so arranged that when the rod end of one cylinder is pressurized to cause the rod to retract, the head end of the other cylinder is pressurized to cause the rod to extend.

To cause the mast 14 to either rotate with the frame 24 or to remain stationary when the frame rotates, as required in a programmed sequence of operations to be described, a brake 32 is mounted on the frame 24 and is actuated by hydraulic cylinder C3 to engage the braking surface 22, so that when so engaged, the mast 14 rotates with the driving frame, and when disengaged, rotation of the driving frame does not cause rotation of the mast, as will appear hereinafter.

To hold the mast 14 in a desired orientation so as to maintain the wing sail 10 in a desired angle to the relative wind, or to allow it to rotate as required by the programmed sequence of operations, a holding brake 34 is mounted on the deck 14 and is actuated by a hydraulic cylinder C4 to bear against the braking surface 22. When so engaged, the brake 34 prevents the mast from rotating in relation to the ship, and when the brake 34 is disengaged, the mast can rotate in relation to the deck.

Figure 7:
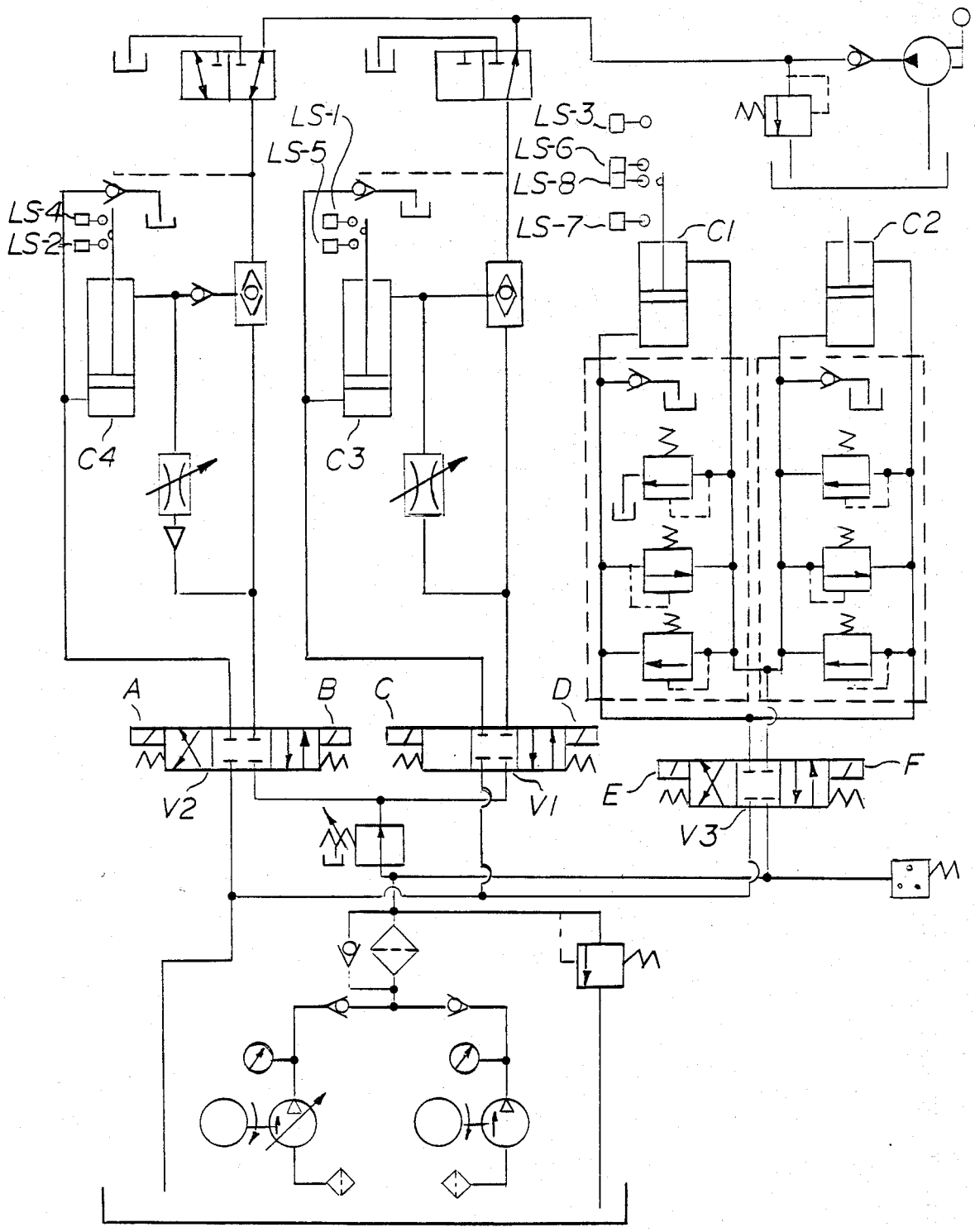
FIG. 7 is a schematic diagram of a control system for the hydraulic cylinders.
Figure 8:
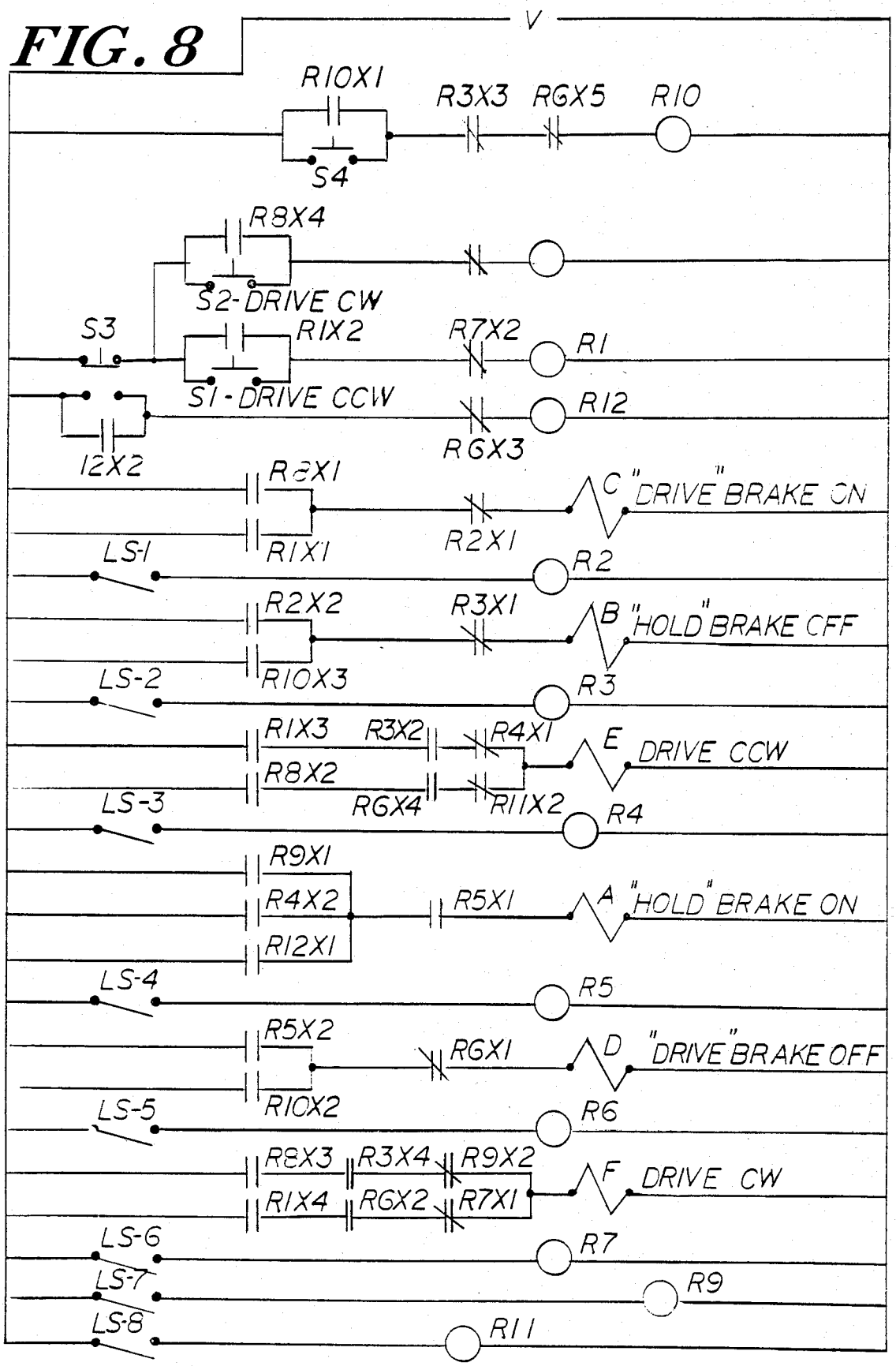
FIG. 8 is a schematic diagram of an electricial circuit for controlling the hydraulic system of FIG. 7.

The device is programmed to operate the cylinders C1–C4 in a sequence such that the wing sail is caused to rotate step-wise in a desired direction by the hydraulic and electricial circuits of FIGS. 7 and 8 in the following manner.

Figure 3:
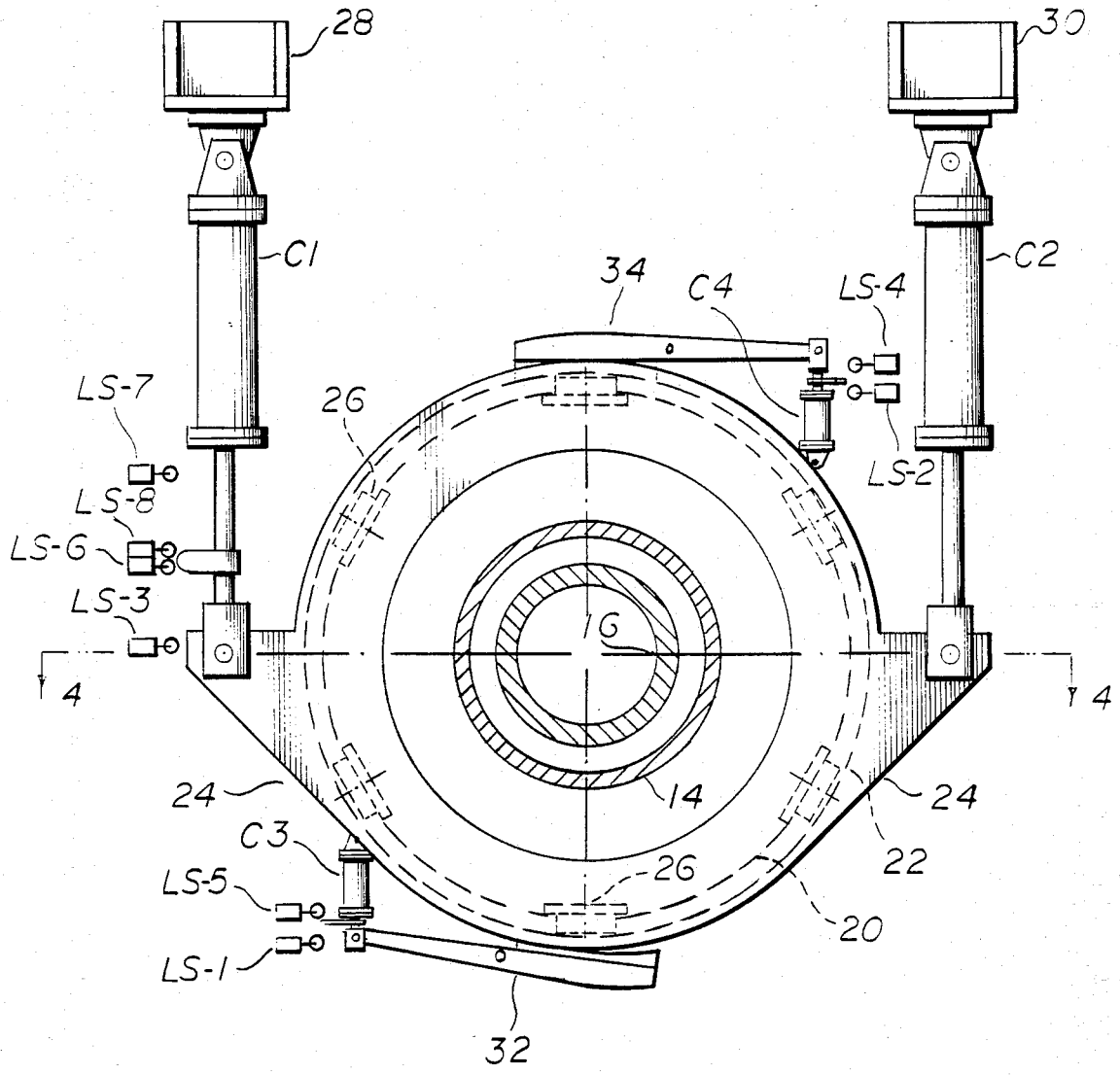
FIG. 3 is a view in section taken on line 3—3 of FIG. 2, with the holding brake engaged, the drive brake released, and the drive cylinders in an intermediate position.
Figure 4:
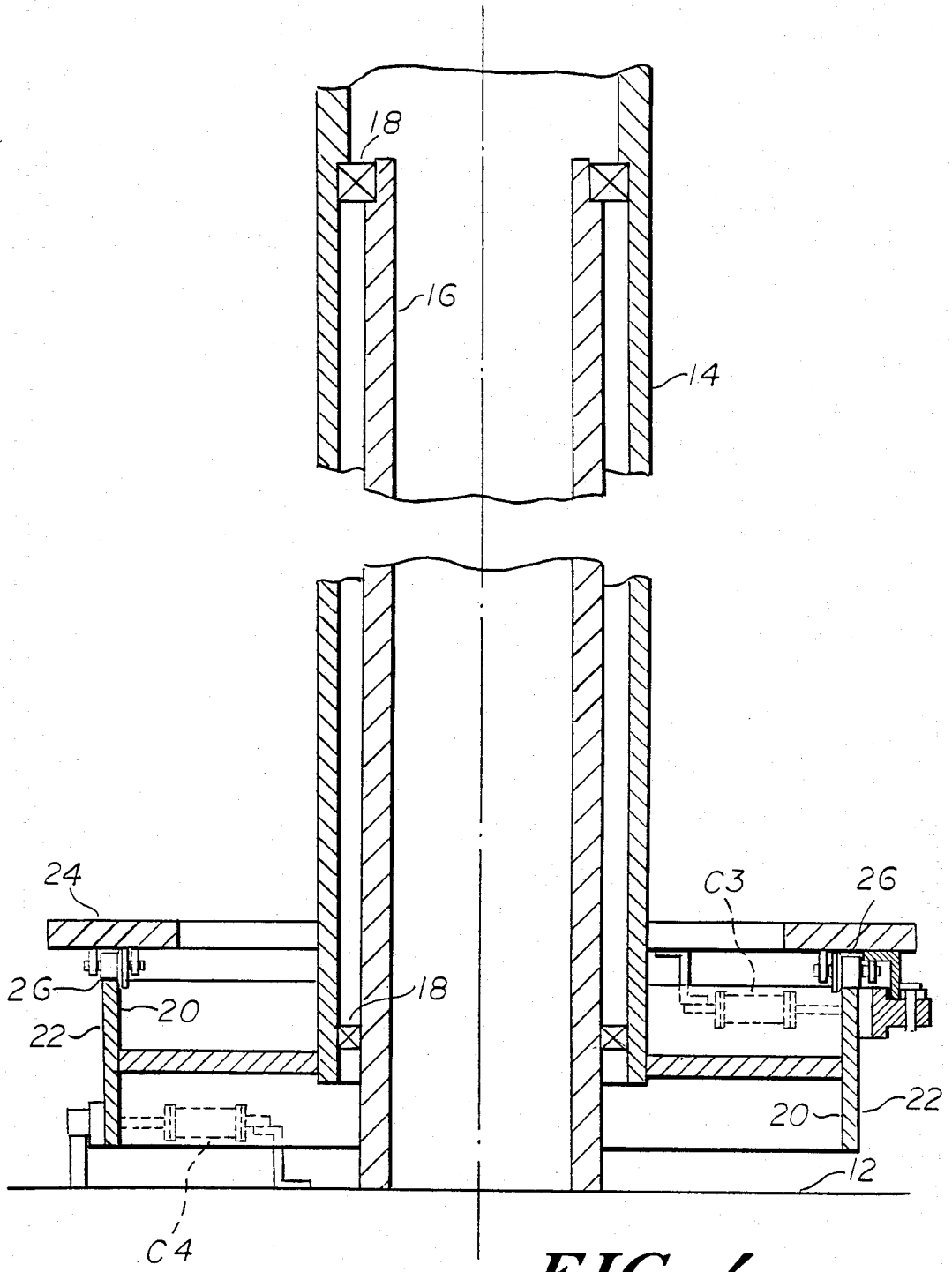
FIG. 4 is a view in section taken on line 4—4 of FIG. 3.
Figure 5:
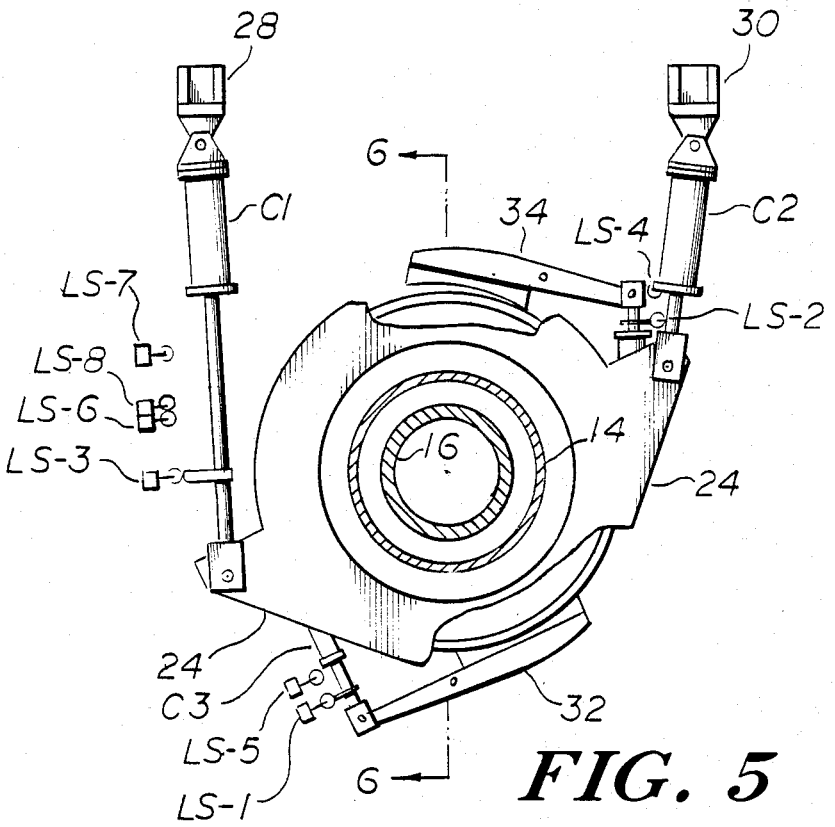
FIGS. 5 and 6 are views similar to FIGS. 3 and 4 respectively, with FIG. 6 being a section on line 6—6 of FIG. 5, in which the holding brake is released, the drive brake is engaged, and the drive cylinders have been actuated to rotate the mast through a predetermined limited angle.
Figure 6:
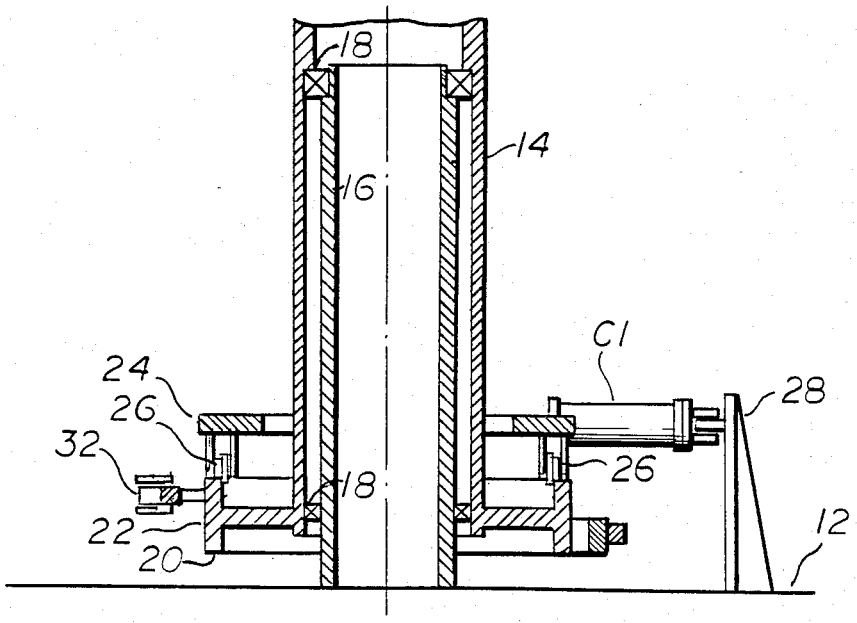

Assuming that the system is energized and pressurized with the hold brake 34 engaged with the braking surface 22, the drive brake is dis-engaged from the braking surface, and the drive cylinders are in their mid-position (see FIG. 3), the wing sail may be driven in a clockwise direction, for example, by pressing "drive CCW" switch S1 (FIG. 8) which causes the following sequence of events:

1. The drive brake is engaged;
2. Engagement of the drive brake causes release of the holding brake;
3. Release of the holding brake causes actuation of the drive cylinders to rotate the drive frame 24 and the mast 14;
4. Full extension of a driving cylinder causes the hold brake to become engaged;
5. Engagement of the holding brake releases the drive brake;
6. Release of the drive brake causes the drive cylinders to reverse position and rotate the frame in the opposite direction;
7. When the drive cylinders return to their mid-position, they stop.

In a more detailed description of the operation, closing switch S1 energizes relay R1 to close switch R1X1 to energize solenoid C, which shifts 3-position valve V1 to actuate drive brake 32 to engage braking surface 22. Relay R1, when energized, also creates a relay holding circuit through contact R1X2.

Full extension of the drive brake cylinder C3 closes a limit switch LS-1 (See FIG. 7) which energizes relay R2, which opens switch R2X1 to deenergize Solenoid C, allowing hydraulic valve V1 to return to the center position, maintaining the drive brake 32 engaged with the braking surface, and closes switch R2X2 to energize solenoid B, which shifts valve V2 to retract cylinder C4 to dis-engage the holding brake 34. Full retraction of holding brake 34 closes limit switch LS-2, energizing relay R3, which opens switch R3X1 to de-energize solenoid B to allow valve V2 to return to the center position to maintain the hold brake in the dis-engaged condition, and closes switch R3X2 to energize solenoid E (switch R1X3 also being closed).

Energization of solenoid E causes valve V3 to shift to cause drive cylinders C1 and C2 to extend and retract, respectively to cause rotation of the driving frame 24.

Full extension of driving cylinder C1 closes limit switch LS-3, which energizes relay R4, opening switch R4X1 to de-energize solenoid E and allow valve V3 to return to the center position to stop the motion of the drive cylinder, and closes switch R4X2 to energize solenoid A.

Energization of solenoid A shifts valve V2 to actuate holding brake cylinder C4 to cause the holding brake 34 to engage the braking surface. Full extension of holding brake cylinder C4 closes limit switch LS-4 to energize relay R5, opening switch R5X1 to de-energize solenoid A to allow valve V2 to return to the center position so that the hold brake 34 remains engaged, and also closes switch R5X2 to energize solenoid D to shift valve V1 to cause cylinder C3 to release the drive brake 32.

Retraction of drive brake 32 closes limit switch LS-5, which energizes relay R6, opening switch R6X1 to de-energize solenoid D, thereby allowing valve V1 to return to the center position to maintain the drive brake engaged, and closes switch R6X2 to energize solenoid F to shift valve V3 to cause cylinder C1 and C2 to retract and extend respectively, thereby rotating the driving frame in a counter-clockwise direction, without rotation of the wing sail.

When cylinder C1 arrives at the neutral position, limit switch LS-6 is closed, energizing relay R7, which opens switch R7X1 to de-energize solenoid F to allow valve V3 to return to the center position to stop the movement of cylinders C1 and C2, and also opens switch R7X2, which de-energizes relay R1 to return the circuit to its original condition.

In a typical embodiment of the invention, one cycle of the system as described above rotates the wing sail about 15°. If a greater amount of rotation is needed, the switch S1 may be pressed again. If 20° of rotation is needed, after the wing sail has rotated the desired amount, stop switch S3 is pressed momentarily, which de-energizes relay R1 to return the circuit to its original condition by de-energizing solenoid E to allow valve V3 to return to the center position to stop the motion of the drive cylinders C1 and C2. Depressing switch S3 also completes a circuit to relay R12, which closes Contacts R12X1 to complete a circuit to solenoid A to actuate valve V2 to actuate hold brake cylinder C3. The extension of hold brake cylinder C3 closes limit switch LS-4 which energizes relay R5 to open switch R5X1 to de-energize solenoid A to lock cylinder C4 in the braking position, and closes switch R5X2 to engage solenoid D to cause the drive brake cylinder C3 to retract to release the drive brake.

Retraction of C3 actuates limit switch LS-5 which energizes relay R6 which opens contact R6X1 to de-energize solenoid D to shift valve V1 to hold the drive brake cylinders in the off position. Relay R6, when energized, also opens switch R6X3 to de-energize relay R12 so that the circuit is ready for another cycle.

The above description applies to rotation of the wing sail in a counterclock-wise direction. Rotation in a clockwise direction is accomplished by pressing "drive CW" switch S2, with the system then operating in a manner analogous to that described above.

In emergency situations, or when the wind velocity is too high to safely utilize the wing sail, it will be desirable to allow the wing sail to feather freely into the wind. This may be accomplished by pressing "feather" switch S4, which energizes relay R10, which closes contact R10X1 to create a holding circuit to the relay R10, and closes contact R10X2 to energize solenoid D to release drive brake 32, and closed switch R10X3 to energize solenoid B to release hold brake 34, thereby allowing for rotation of the wing sail.

Free rotation can be stopped when desired by pressing stop switch S3 momentarily which energizes relay R12, closing switch R12X1 to energize solenoid A to cause engagement of the holding brake, as previously described.

Although in the above described embodiment of the invention, the hold and drive brakes are single pads bearing against the braking surface, it will be understood that if necessary, the braking elements can be continuous bands extending around the braking surface.

In some cases the means for rotating the mast and the rotating frame may be mechanical, rather than hydraulic or pneumatic cylinders.

Since certain other changes apparent to one skilled in the art may be made in the herein described embodiments of the invention without departing from the scope thereof, it is intended that all matter contained herein be interpreted in an illustrative and not a limiting sense.

We claim:

1. A mast rotating means for a mast rotatbly mounted on a support, comprising a rotatable mast driving structure disposed around the mast, first releasable means for rendering the mast non-rotatable in relation to the support, second releasable means for rendering the mast driving structure non-rotatable in relation to the mast, means for causing rotation of said mast driving structure in a desired direction when the mast driving structure is rendered non-rotatable in relation to the mast, and third means for causing rotation of the drive structure in the opposite direction when the second releasable means is released to allow the drive structure to rotate in relation to the mast and when the first releasable means has rendered the mast non-rotatable in relation to the support, in which release of the first releasable means causes engagement of the second releasable means, and the engagement of the second releasable means causes said third means to rotate the mast through a predetermined arc.

2. A mast rotating means as set out in claim 1 in which rotation of said mast through said predetermined arc causes said first releasable means to become engaged to prevent rotation of the mast, engagement of said first releasable means causes disengagement of said second releasable means to allow the mast driving structure to rotate in relation to the mast, and dis-engagement of said second releasable means causes said mast driving structure to rotate in the opposite direction.

3. A rotatable mast and mast driving system, comprising a rotatable mast mounted on a support, said mast carrying a member having braking surfaces, a mast rotating structure mounted on the member, a holding brake mounted on the support and engagable with a braking surface to prevent rotation of the mast in relation to the support, a driving brake mounted on the mast rotating structure and engagable with a braking surface to prevent relative rotation between the mast and the mast rotating structure, drive means for causing rotation of the mast rotating structure through a limited arc in a pre-determined direction, and means for causing, in sequence, the release of the holding brake, engagement of the drive brake, actuation of the drive means to cause rotation of the mast rotating structure and the mast through said pre-determined limited arc, engagement of the holding brake, release of the drive brake, and actuation of the drive means to cause rotation of only the mast rotating structure in the direction of rotation opposite to said pre-determined direction.

4. A system as set out in claim 3 in which the release of the holding brake causes engagement of the drive brake, and engagement of the drive brake causes actuation of the drive means to drive said mast rotating structure and said mast in said pre-determined direction.

5. A system as set out in claim 4 in which the rotation of the mast rotating structure through said pre-determined limited arc causes de-actuation of said drive means, which causes engagement of the holding brake, which causes release of the drive brake, which causes the actuation of the drive means to rotate the mast rotating structure in said opposite direction.

6. A system as set out in claim 3 in which the drive brake and the holding brake may be dis-engaged at the same time to allow free rotation of the mast.

* * * * *